US007383858B2

(12) United States Patent
Hsueh

(10) Patent No.: US 7,383,858 B2
(45) Date of Patent: Jun. 10, 2008

(54) CONTROL VALVE ASSEMBLY FOR A FAUCET

(76) Inventor: Yen-Yao Hsueh, No. 148, Hao Lai 1st St., Li Jen Vill., Ta Li City, Taichung Hsien (TW)

( * ) Notice: Subject to any disclaimer, the term of this patent is extended or adjusted under 35 U.S.C. 154(b) by 0 days.

(21) Appl. No.: 11/685,846

(22) Filed: Mar. 14, 2007

(65) Prior Publication Data

US 2008/0083466 A1 Apr. 10, 2008

(30) Foreign Application Priority Data

Oct. 4, 2006 (TW) ..... 95217760 U

(51) Int. Cl.
*F16K 15/18* (2006.01)

(52) U.S. Cl. ..... 137/614.2; 137/613; 137/454.6

(58) Field of Classification Search ..... 137/614.2, 137/613, 454.5, 454.6
See application file for complete search history.

(56) References Cited

U.S. PATENT DOCUMENTS

| | | | | |
|---|---|---|---|---|
| 5,215,121 | A * | 6/1993 | Michl | 137/614.2 |
| 5,404,905 | A * | 4/1995 | Lauria | 137/613 |
| 6,349,736 | B1 * | 2/2002 | Dunmire | 137/613 |
| 6,880,573 | B2 * | 4/2005 | Berkman et al. | 137/614.2 |
| 6,929,029 | B1 * | 8/2005 | Chung | 137/454.6 |
| 7,140,390 | B2 * | 11/2006 | Berkman et al. | 137/454.6 |

* cited by examiner

*Primary Examiner*—Kevin L Lee
(74) *Attorney, Agent, or Firm*—Ming Chow; Sinorica, LLC

(57) ABSTRACT

A control valve assembly includes a first control valve and a second control valve longitudinally mounted to the first control valve. A first check valve and a second check valve respectively disposed in the first control valve and the second control valve such that the leakproof effect of the control valve assembly is doubled.

3 Claims, 9 Drawing Sheets

CONTROL VALVE ASSEMBLY FOR A FAUCET

BACKGROUND OF THE INVENTION

1. Field of the Invention

The present invention relates to a control valve assembly, and more particularly to a control valve assembly for a faucet.

2. Description of Related Art

A conventional control valve in accordance with the prior art shown in FIG. 9 comprises a seat (80) having a controller (81) rotatably received therein. A check valve (82) is mounted to a top portion of the seat (80). The controller (81) is rotated to selectively open the outlet. The water pushes the check valve (82) and passes through the check valve (82) when the outlet is opened. The passed water pushes back the check valve (82) for closing the outlet when the outlet is closed. However, the check valve (82) may be folded and leaks when a siphon phenomenon is occurred in the faucet.

The present invention has arisen to mitigate and/or obviate the disadvantages of the conventional control valve.

SUMMARY OF THE INVENTION

The main objective of the present invention is to provide an improved control valve assembly for a faucet that has a doubled leakproof effect.

To achieve the objective, control valve assembly in accordance with the present invention comprises a first control valve and a second control valve longitudinally mounted to the first control valve. A first check valve and a second check valve respectively disposed in the first control valve and the second control valve such that the leakproof effect of the control valve assembly is doubled.

Further benefits and advantages of the present invention will become apparent after a careful reading of the detailed description with appropriate reference to the accompanying drawings.

DETAILED DESCRIPTION OF THE INVENTION

Figure 1:
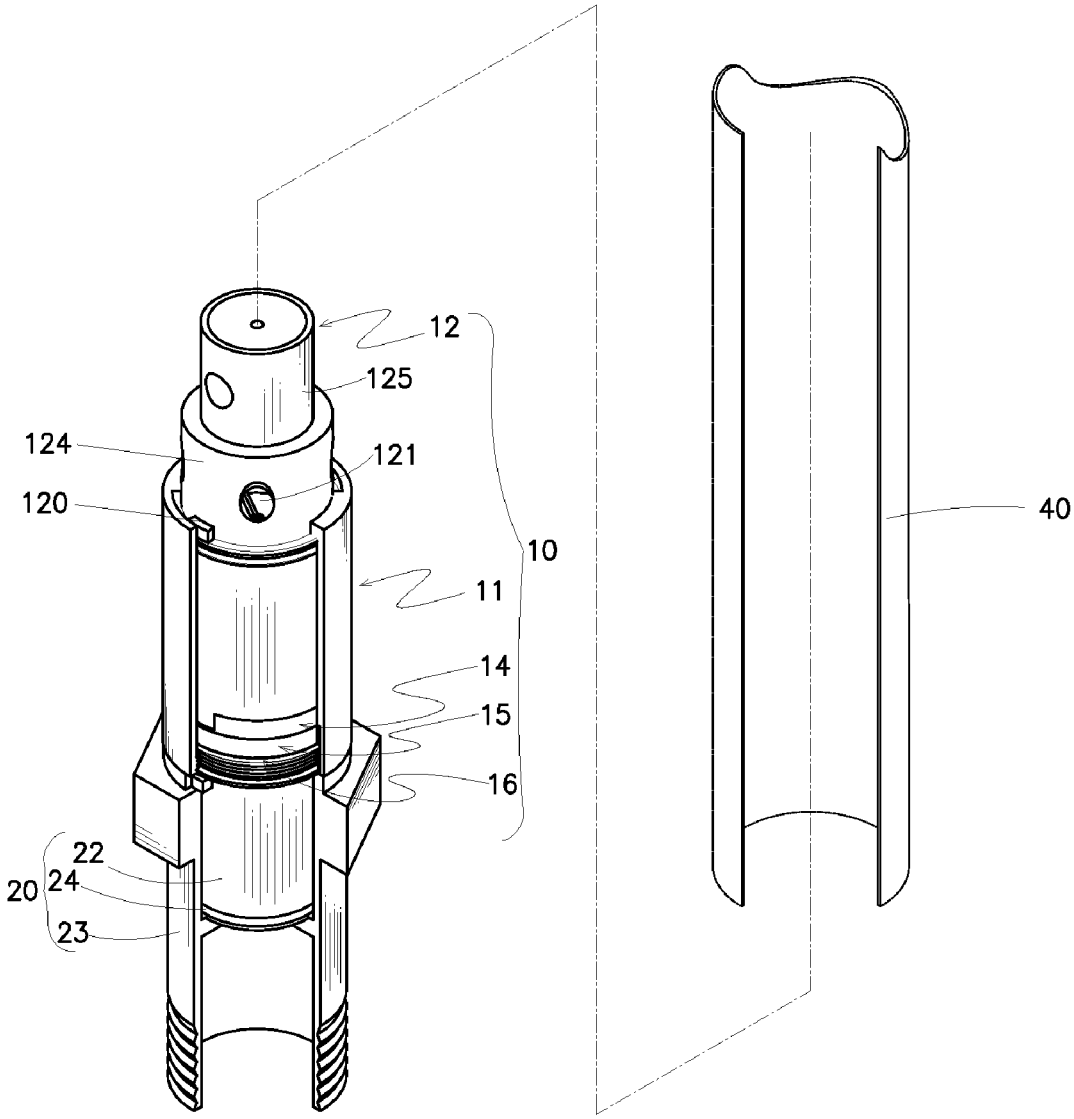
FIG. 1 is a perspective view of a control valve assembly for a faucet in accordance with the present invention.
Figure 2:
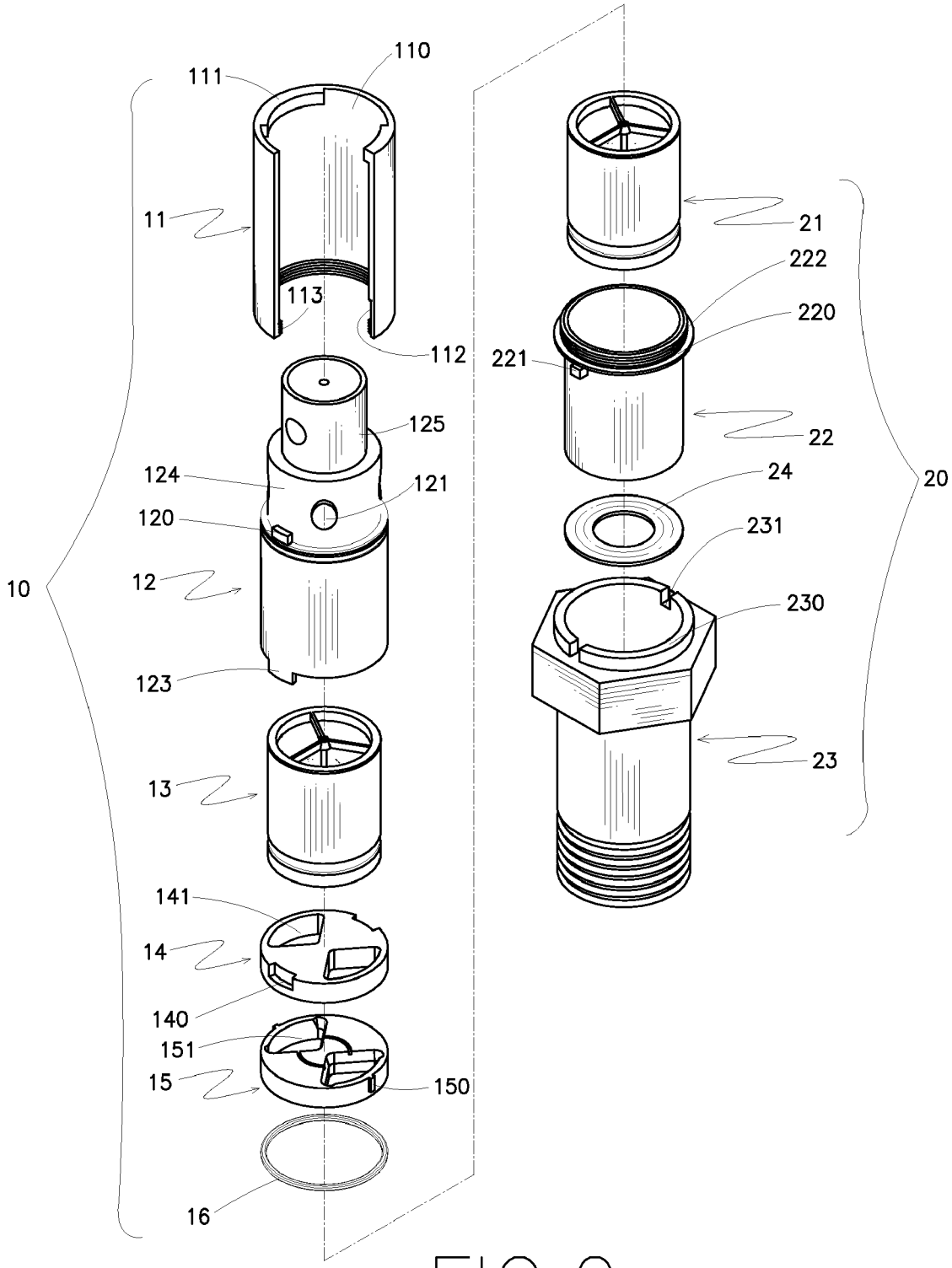
FIG. 2 is an exploded perspective view of the control valve assembly in FIG. 1.
Figure 3:
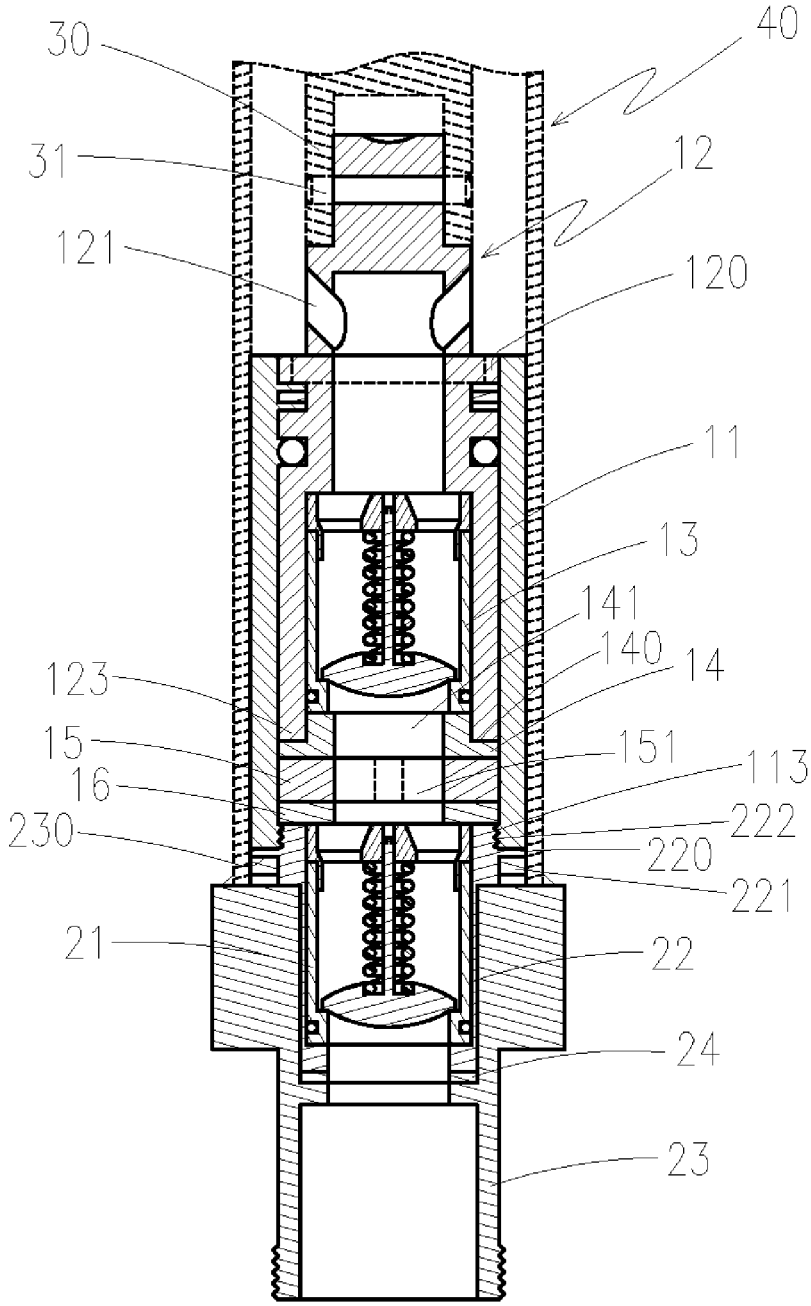
FIG. 3 is a cross-sectional view of the control valve assembly in FIG. 1.

Referring to the drawings and initially to FIGS. 1-3, a control valve assembly for a faucet in accordance with the present invention comprises a first control valve (10) and a second control valve (20) longitudinally connected to the first control valve (10).

The first control valve (10) comprises an outer sleeve (11) having two stop members (111) inward extending from a first end thereof to define two sector grooves (110). The two stop members (111) diametrically correspond to each other. A threaded portion (113) is formed on an inner periphery of a second end of the outer sleeve (11) and two limit grooves (112) are defined in the inner periphery upon the threaded portion (113). An outlet controller (12) is partially and rotatably received in the outer sleeve (11). The outlet controller (12) has a stub (124) extending through the outer sleeve (11) and a connecting bar (125) centrally and longitudinally extending from the stub (124). Two protrusions (120) laterally extend from the stub (124) and each moved within a corresponding one of the two sector grooves (110) when the outlet controller (12) is rotated. The two protrusions (120) diametrically correspond to each other. A receiving space (122) is defined in the outlet controller (12) opposite to the connecting bar (125). Multiple outlet ports (121) are defined in the stub (124) and communicate with the receiving space (122). In the preferred embodiments of the present invention, each outlet port (121) extends toward the connecting bar (125) about 45° relative to an axis of the outlet controller (12). Two prongs (123) longitudinally extending from one end of the outlet controller (12) opposite to the connecting bar (125).

"A first check valve (13) is received in the receiving space (122) and a first disc (14) is mounted to the outlet controller (12). The first disc (14) has two recesses (140) defined in a brink thereof for respectively receiving the two prongs (123) to prevent the first disc (14) from being rotated relative to the outlet controller (12). The first disc (14) has multiple through holes (141) defined therein and communicating with an interior of the first check valve (13). A second stationary disc (15) is received in the outer sleeve (11) and abuts against the first disc (14). The second stationary disc (15) has two limiters (150) laterally extending therefrom and respectively received in the two limit grooves (112) in the outer sleeve (11) to prevent the second stationary disc (15) from being rotated relative to the outer sleeve (11). The second stationary disc (15) has multiple through holes (151) defined therein and selectively communicating with a corresponding one of the multiple through holes (141) in the first disc (14) when the first disc (14) is rotated relative to the second stationary disc (15) due to the outlet controller (12)."

The second control valve (20) comprises a second check valve (21) received in an inner sleeve (22) that is longitudinally mounted to the outer sleeve (11) of the first control valve (10). The inner sleeve (22) has an annular flange (220) outward extending therefrom and a threaded portion (222) longitudinally extending from the annular flange (220). The threaded portion (222) of the inner sleeve (22) is screwed into the threaded portion (113) to connect the inner sleeve (22) and the outer sleeve (11). An O-ring (16) is disposed between the second stationary disc (15) and the inner sleeve (22) for providing a leakproof effect. The inner sleeve (22) has two protrusions (221) laterally extending therefrom under the annular flange (220). A valve seat (23) is adapted to be connected to a pipe (not shown) and sleeved the inner sleeve (22). The valve seat (23) has an annular flange (230) longitudinally extending therefrom to abut against the annular flange (220) of the inner sleeve (22). Two indentations (231) are defined in the annular flange (230) to respectively the two protrusions (221) of the inner sleeve (22). A leakproof washer (24) is disposed between the valve seat (23)

and the inner sleeve (22) for providing a leakproof effect. Further with reference to FIG. 7, the inner sleeve (22) is driven to securely abut the leakproof washer (24) due to the outlet controller (12) when the control valve assembly in accordance with present invention is assembled to the faucet.

Figure 4:
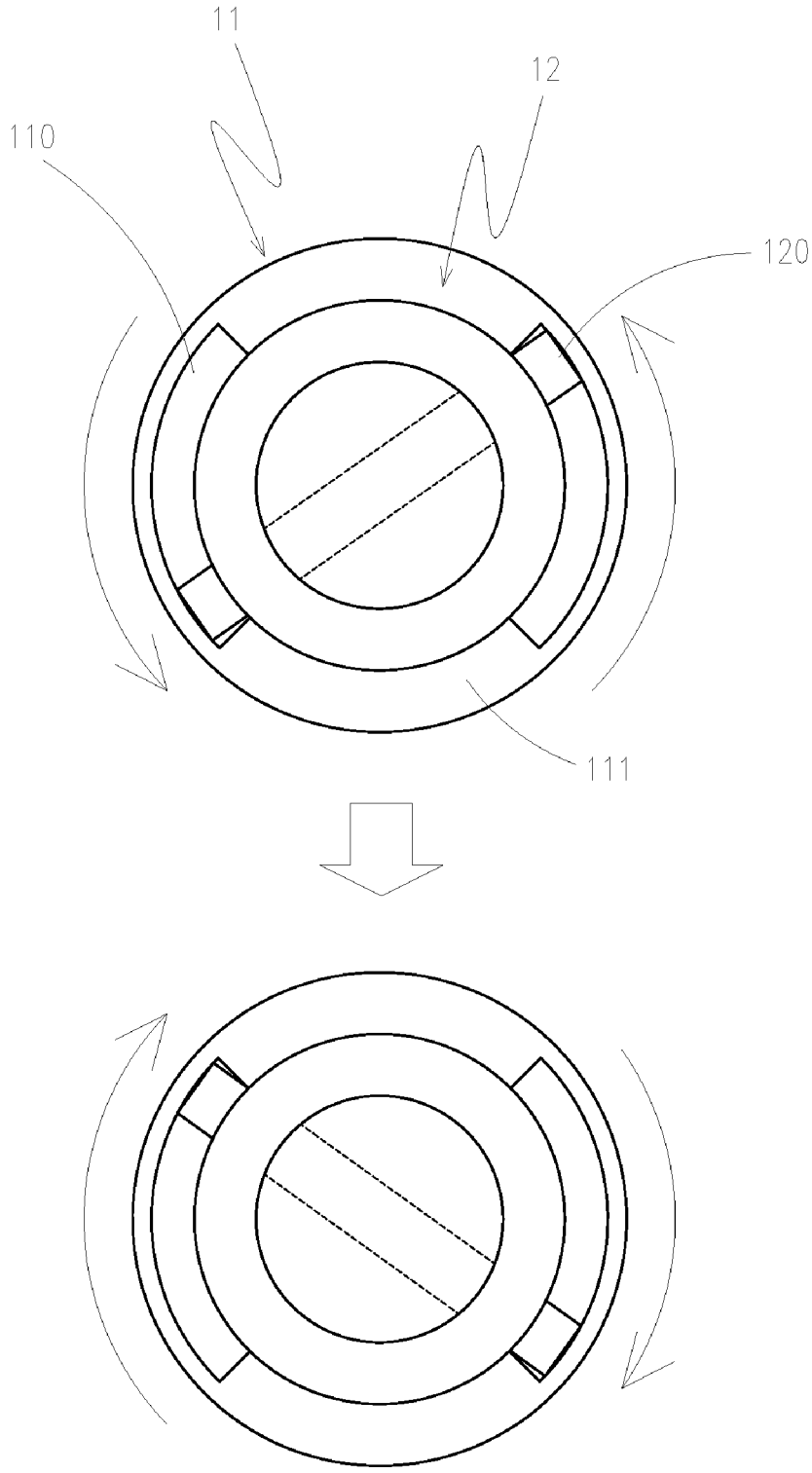
FIG. 4 is a first operational view of the control valve assembly of the present invention.
Figure 5:
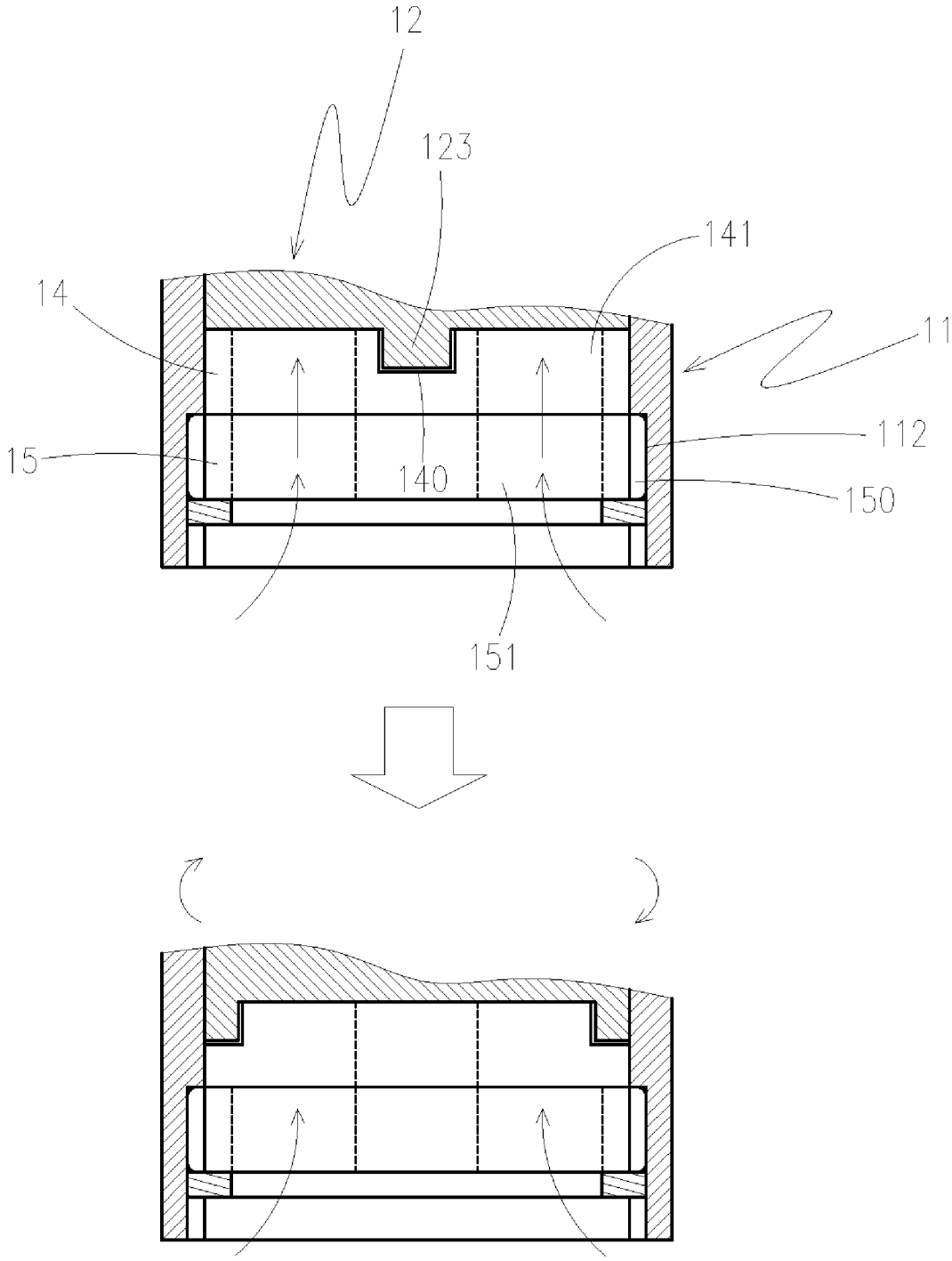
FIG. 5 is a second operational view of the control valve assembly of the present invention.
Figure 6:
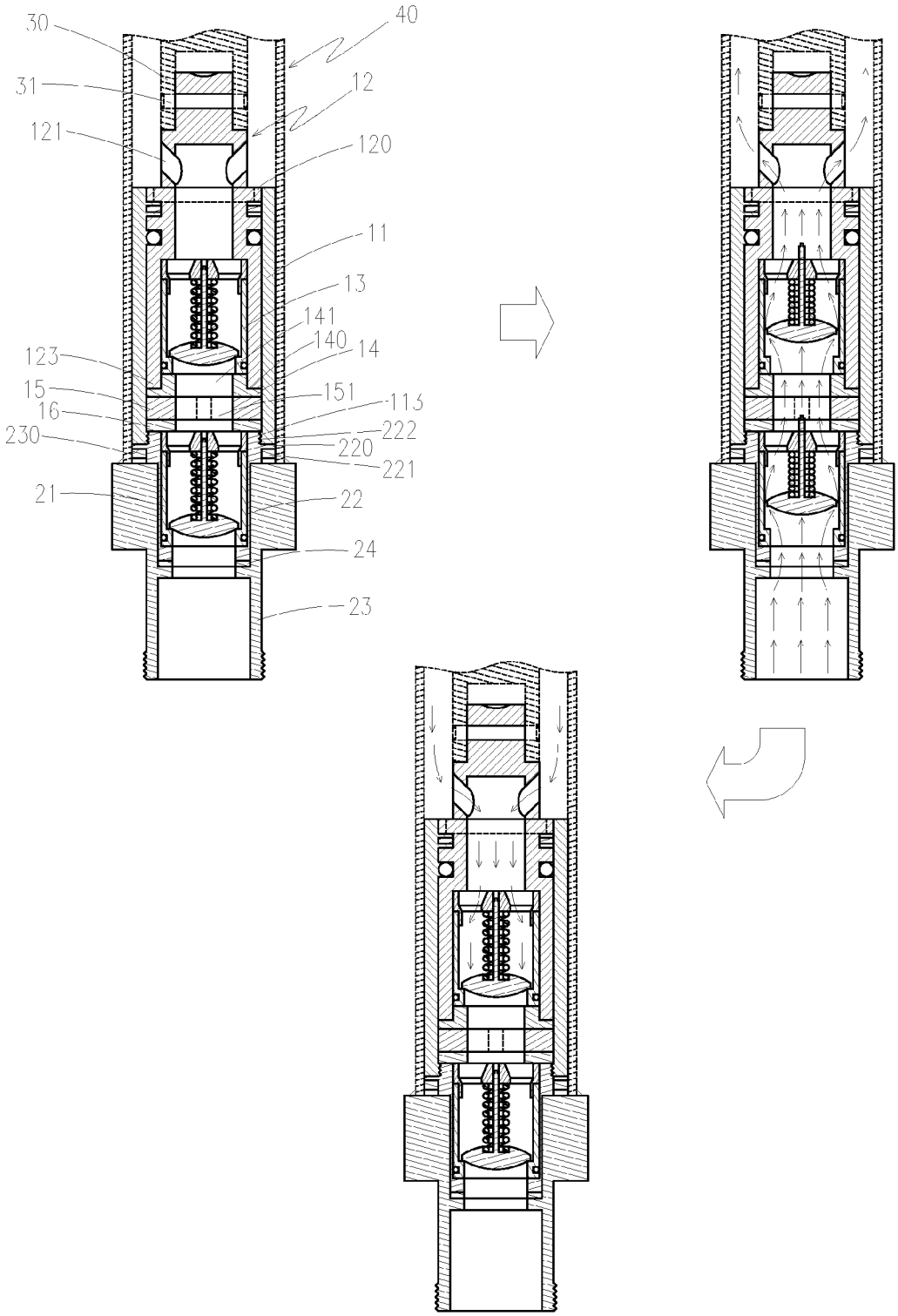
FIG. 6 is a third operational view of the control valve assembly of the present invention.

"With reference to FIGS. 4-6, the pressure of the water pushes and opens the second check valve (21) in the second control valve (20) and the first check valve (13) when the through holes (141) in the first disc (14) communicate with the through holes (151) in the second stationary disc (15). As a result, the water flows into the faucet sequentially via the second check valve (21), the two discs (15, 14), the first check valve (13) and the outlet ports (121) in the outlet controller (12). The first check valve (13) and the second check valve (21) are closed due to the resilient members (not numbered) in the first check valve (13) and the second check valve (21) when the through holes (141) in the first disc (14) do not communicate with the through holes (151) in the second stationary disc (15) and the pressure of the water does not affect the second check valve (21)."

Figure 7:
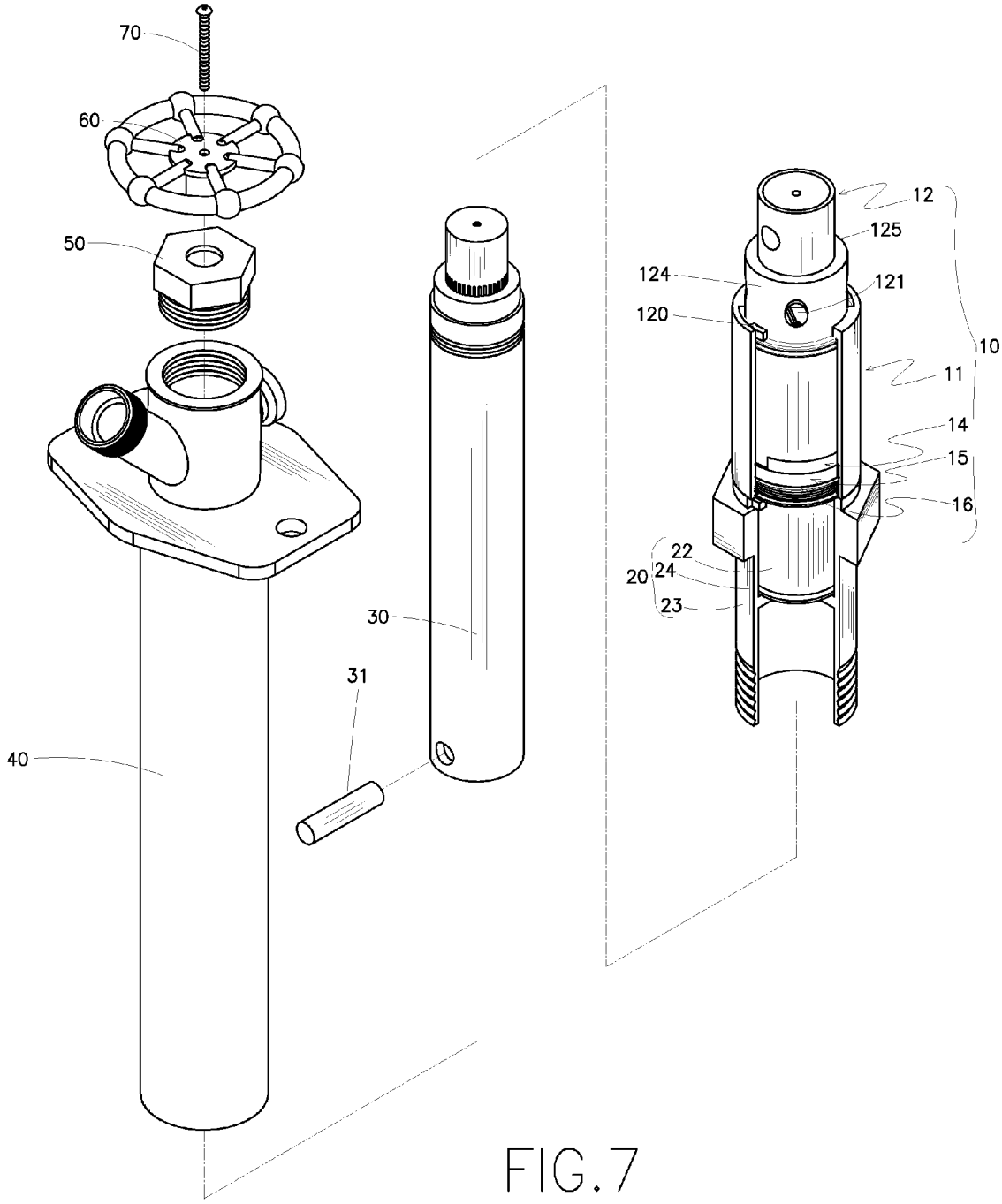
FIG. 7 is a schematic view of the control valve assembly in accordance with the present invention.

With reference to FIG. 7, the faucet includes a valve stem (30) having a first end sleeved the connecting bar (125), and a pin (31) extending through the valve stem (30) and the connecting bar (125) to connect the outlet controller (12) and the valve stem (30). A sleeve assembly (40) is sleeved the valve stem (30) and the outer sleeve (11), and weld to the valve seat (23). A poppet (50) is mounted to the sleeve assembly (40) to prevent the valve stem (30) from detaching from the sleeve assembly and pushes the inner sleeve (22) to securely abut against the leakproof washer (24).

"A handle (60) is provided to connected to a second end of the valve stem (30) by a bolt (70) such that the valve stem (30) drives the outlet controller (12) with the first disc (14) when the handle (60) is operated."

Figure 8:
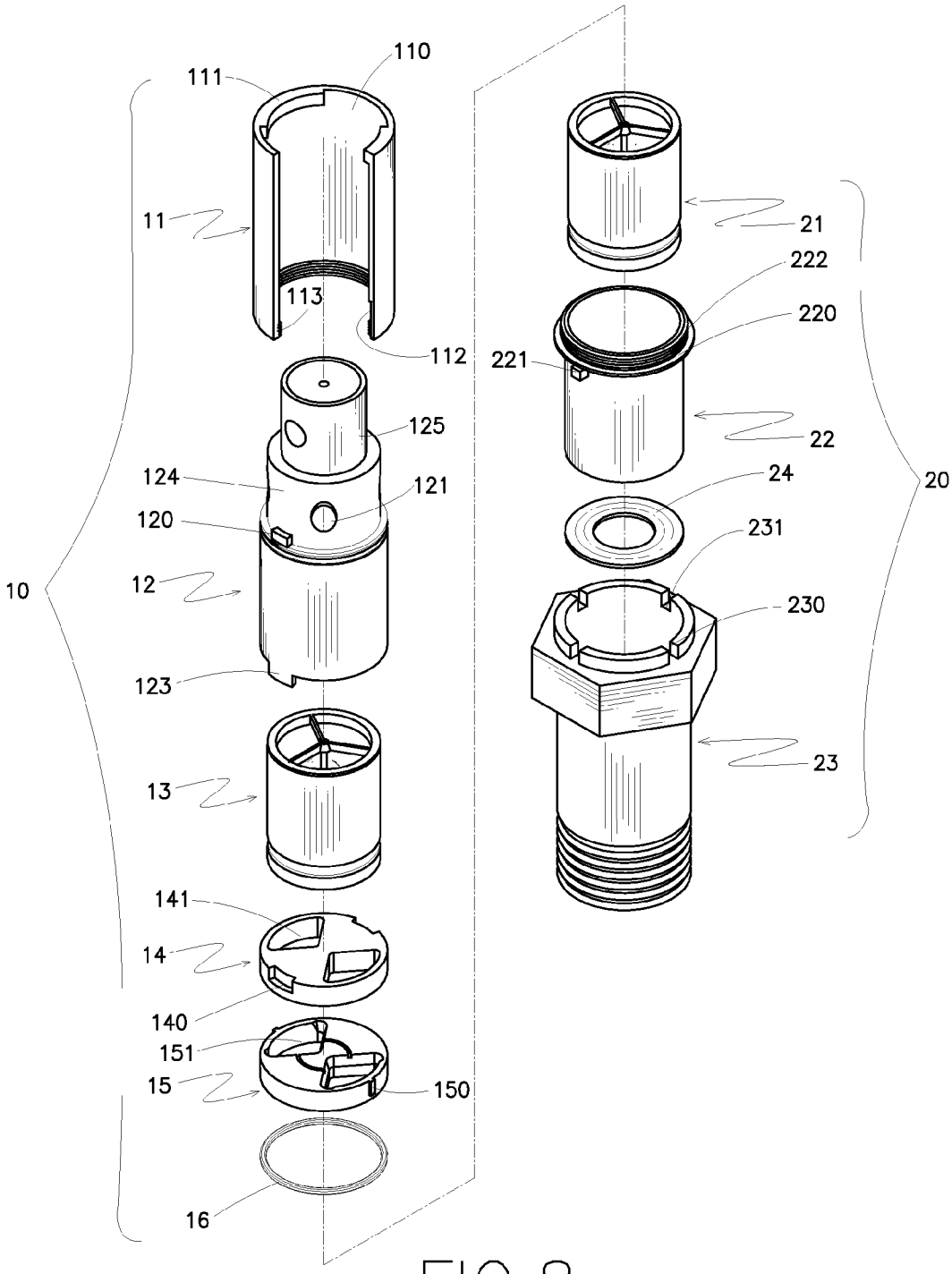
FIG. 8 is an exploded perspective view of a second embodiment of the control valve assembly in accordance with the present invention.
Figure 9:
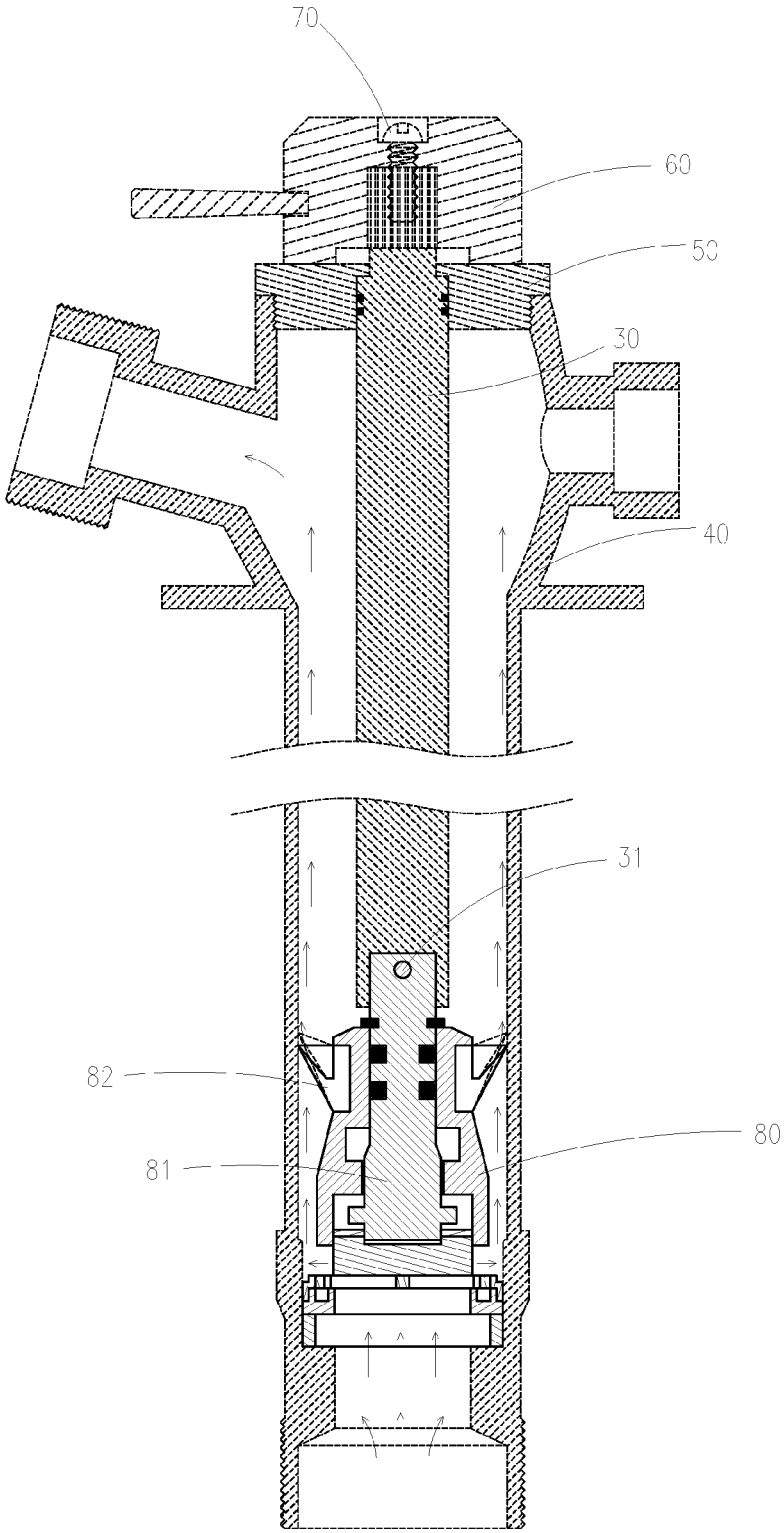
PRIOR ART FIG.9
FIG. 9 is a schematic view of a conventional control valve for a faucet in accordance with the prior art.

With reference to FIG. 8 that shows a second embodiment of the control valve assembly in accordance with the present invention, the inner sleeve (22) has four protrusions (221) laterally extending therefrom under the annular flange (220) and the valve seat (23) has four indentations (231) defined in the annular flange (230) to respectively the four protrusions (221) of the inner sleeve (22) such that inner sleeve (22) can bear more torsion force when assembling the valve seat (23).

Although the invention has been explained in relation to its preferred embodiment, it is to be understood that many other possible modifications and variations can be made without departing from the spirit and scope of the invention as hereinafter claimed.

What is claimed is:

1. A control valve assembly for a faucet, comprising:

a first control valve including an outer sleeve having two stop members inward extending from a first end thereof to define two sector grooves, the two stop members diametrically corresponding to each other, an outlet controller partially and rotatably received in the outer sleeve, the outlet controller having a stub extending through the outer sleeve and a connecting bar centrally and longitudinally extending from the stub, the connecting bar adapted to be connected to a valve stem of the faucet, two protrusions laterally extend from the stub and each moved within a corresponding one of the two sector grooves when the outlet controller is rotated, the two protrusions diametrically corresponding to each other, a receiving space defined in the outlet controller opposite to the connecting bar, multiple outlet ports defined in the stub and communicating with the receiving space, a first check valve received in the receiving space and engaged to the outlet controller, a first disc having multiple through holes defined therein and communicating with an interior of the first check valve, a second stationary disc received in the outer sleeve abutting against the first disc and engaged to an inner periphery of the outer sleeve, the second stationary disc having multiple through holes defined therein and selectively communicating with a corresponding one of the multiple through holes in the first disc when the first disc is rotated relative to the second stationary disc due to the outlet controller; and a second control valve longitudinally connected to the first control valve, the second control valve comprising a second check valve received in an inner sleeve that is longitudinally and sealingly mounted to the outer sleeve of the first control valve, a valve seat adapted to be connected to a pipe, the valve seat sleeved and engaged to the inner sleeve, a leakproof washer disposed between the valve seat and the inner sleeve for providing a leakproof effect.

2. The control valve assembly as claimed in claim 1, wherein each outlet port extends toward the connecting bar about 45° relative to an axis of the outlet controller.

3. The control valve assembly as claimed in claim 1, wherein the inner sleeve has at least two protrusions laterally extending therefrom and the valve seat has at least two indentations defined therein to respectively the at least two protrusions of the inner sleeve.

* * * * *